US011299919B2

(12) United States Patent
Nelsen et al.

(10) Patent No.: US 11,299,919 B2
(45) Date of Patent: Apr. 12, 2022

(54) DUAL ACTUATED LATCH MECHANISM FOR A VEHICLE

(71) Applicants: GM GLOBAL TECHNOLOGY OPERATIONS LLC, Detroit, MI (US); PyeongHwa Automotive Co., Ltd., Daegu (KR)

(72) Inventors: James N. Nelsen, Howell, MI (US); Sung Han Kim, Daegu (KR)

(73) Assignees: GM Global Technology Operations LLC, Detroit, MI (US); PyeongHwa Automotive USA, L.L.C., Auburn Hills, MI (US)

( * ) Notice: Subject to any disclaimer, the term of this patent is extended or adjusted under 35 U.S.C. 154(b) by 406 days.

(21) Appl. No.: 16/444,622

(22) Filed: Jun. 18, 2019

(65) Prior Publication Data

US 2020/0399937 A1 Dec. 24, 2020

(51) Int. Cl.
*E05B 83/24* (2014.01)
*E05B 79/20* (2014.01)

(52) U.S. Cl.
CPC ..... *E05B 83/24* (2013.01); *E05B 79/20* (2013.01); *E05Y 2900/536* (2013.01)

(58) Field of Classification Search
CPC ..... E05B 83/16; E05B 83/24; E05B 79/04; E05B 79/20; E05B 85/245; E05B 85/26; Y10T 292/08; Y10T 292/081; Y10T 292/0801; Y10T 292/0825; Y10T 292/0828; Y10T 292/0853; Y10T 292/0855; Y10T 292/083; Y10T 292/0921;

(Continued)

(56) References Cited

U.S. PATENT DOCUMENTS 2,877,038 A * 3/1959 Kramer ..... E05B 83/16 292/216
2,924,473 A * 2/1960 Krause ..... E05B 83/16 292/11

(Continued)

FOREIGN PATENT DOCUMENTS

DE 102007003293 A1 * 7/2008 ..... E05B 83/24
KR 20170119013 A * 10/2017

OTHER PUBLICATIONS

Computer Generated Translation for DE102007003293A1, Generated on Sep. 24, 2021, https://worldwide.espacenet.com/ (Year: 2021).*

*Primary Examiner* — Alyson M Merlino
(74) *Attorney, Agent, or Firm* — Quinn IP Law

(57) ABSTRACT

A latching mechanism releasably engages a striker. The latching mechanism includes a housing secured to the vehicle body, and defining a striker channel through which the striker is selectively movable along a striker path. The latching mechanism includes a release lever pivotally connected to the housing and configured to rotate in a first direction in response to a tensile force. A detent is pivotally connected to the housing and to the release lever, and is movable with lost motion relative to the release lever. A fork bolt is adjustably connected to the housing and movable between a fully latched position, where the fork bolt fixes the striker relative to the housing, and a secondary position, where the striker is movable relative to the housing. Moving the fork bolt from the secondary position to the fully latched position causes the lost motion between the detent and the release lever.

14 Claims, 8 Drawing Sheets

(58) Field of Classification Search
CPC ..... Y10T 292/1044; Y10T 292/1047; Y10T 292/1057; Y10T 292/1078; Y10S 292/14
See application file for complete search history.

(56) References Cited

U.S. PATENT DOCUMENTS

| | | | | |
|---|---|---|---|---|
| 3,905,624 | A * | 9/1975 | Fujita | E05B 83/16 292/11 |
| 6,547,291 | B1 * | 4/2003 | Schwaiger | E05B 83/16 292/109 |
| 10,697,209 | B2 * | 6/2020 | Kim | E05B 83/24 |
| 11,118,381 | B2 * | 9/2021 | Nelsen | E05B 81/16 |
| 2018/0030763 | A1 * | 2/2018 | Distefano | E05B 83/24 |
| 2021/0002929 | A1 * | 1/2021 | Nelsen | E05B 83/24 |

* cited by examiner

DUAL ACTUATED LATCH MECHANISM FOR A VEHICLE

INTRODUCTION

The disclosure relates to hood latch mechanisms for vehicles, and, more particularly, to a dual actuated hood latch mechanism having a remotely operated primary latching member and a secondary latching member.

SUMMARY

A latching mechanism, which may be used with a vehicle, is provided. The latching mechanism may cooperate with a vehicle body defining a compartment, and a hood panel that is adjustably mounted to the vehicle body and configured to selectively cover and uncover the compartment. A striker is fixedly attached to the hood panel.

The latching mechanism releasably engages the striker, and includes a housing secured to the vehicle body, and defining a striker channel through which the striker is selectively movable along a striker path. The latching mechanism also includes a release lever and a detent. The release lever is pivotally connected to the housing and configured to rotate in a first direction in response to a tensile force exerted by a release cable. The detent is pivotally connected to the housing and to the release lever. The detent is movable with lost motion relative to the release lever.

A fork bolt is adjustably connected to the housing and is movable between a fully latched position, in which the fork bolt fixes the striker relative to the housing, and a secondary position, in which the striker is movable relative to the housing. Moving the fork bolt from the secondary position to the fully latched position causes the lost motion between the detent and the release lever.

The latching mechanism may also include a secondary catch that is pivotally connected to the housing. The secondary catch has a first lever arm, a second lever arm extending from the first lever arm at an acute angle, and a secondary hook portion extending from the first lever arm opposite the second lever arm. A first biasing member operates bi-directionally to apply a force to selectively bias the secondary catch to rotate in opposing directions. The secondary catch is selectively pivotable between a first position, in which the secondary hook portion is aligned with the striker channel and blocks movement of the striker beyond the striker channel, and a second position, in which the secondary hook portion is not aligned with the striker channel along the striker path and the striker is moveable beyond the striker channel.

The latching mechanism may also include a cancel lever pivotally mounted to the second lever arm of the secondary catch opposite the intersection of the first lever arm and the second lever arm. An arm extends from the cancel lever generally toward the first lever arm of the secondary catch. A cancel biasing member bi-directionally urges the cancel lever to pivotally rotate from a zero point in a first direction causing the cancel lever to engage the second lever arm, thus limiting the pivot of the cancel lever in the first direction, and a second direction causing the cancel lever to move away from the second lever arm.

The cancel lever may have an exterior cam surface formed on the arm opposite the secondary catch. The exterior cam surface is configured such that a force applied along the striker path onto the exterior cam surface, when the secondary catch is in the second position, induces a moment onto the second lever arm causing the secondary catch to rotate into the first position.

The cancel lever may also have an interior cam surface, such that the exterior cam surface of the cancel lever transitions through an apex to the interior cam surface. The apex extends sufficiently into the striker channel, when the secondary catch is in the second position, that the striker contacts the exterior cam surface upon closing the hood panel. The apex also extends sufficiently into the striker channel, when the secondary catch is in the first position, that the striker contacts the interior cam surface upon opening the hood panel.

The latching mechanism may have a latch cam surface formed on the second lever arm of the secondary catch. The latch cam surface is configured such that a force applied along the striker path onto the latch cam surface, when the secondary catch is in the second position, causes the secondary catch to pivot to the first position, even if the cancel lever is stuck rotated in the second direction.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Figure 1:
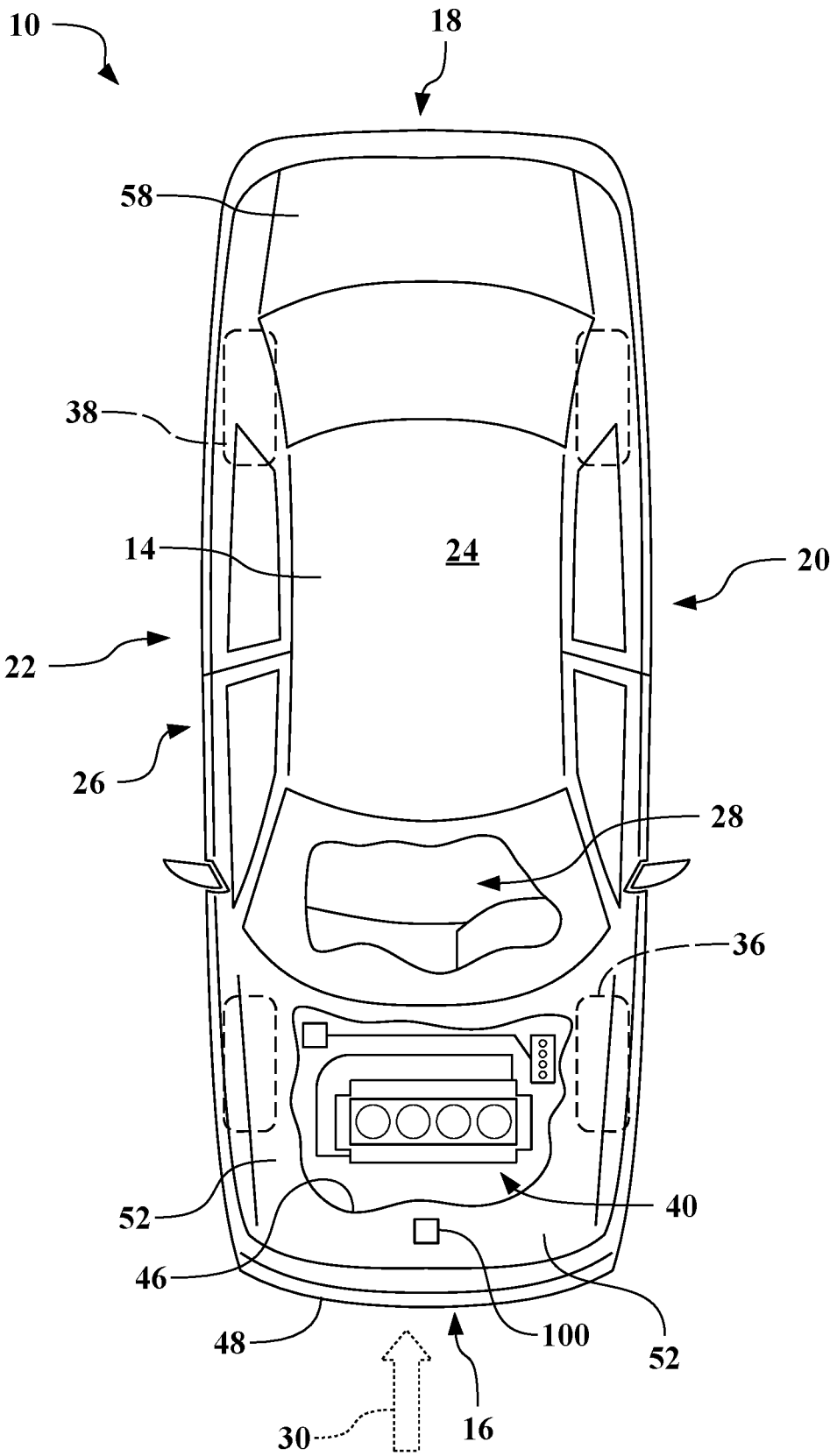
FIG. 1 is a schematic top view of a vehicle showing a partially sectioned hood panel and an under-hood compartment covered thereby, according to the disclosure.

Referring to the drawings, wherein like reference numbers correspond to like or similar components throughout the several Figures, an example vehicle 10 is shown schematically in FIG. 1. The vehicle 10 may include, but not be limited to, a commercial vehicle, industrial vehicle, passenger vehicle, aircraft, watercraft, train or any mobile platform. It is also contemplated that the vehicle 10 may be any mobile or rolling platform, such as an airplane, all-terrain vehicle (ATV), boat, personal movement apparatus, robot and the like to accomplish the purposes of this disclosure. For purposes of convenience and clarity, directional terms such as top, bottom, left, right, up, over, above, below, beneath, rear, and front, may be used with respect to the drawings. These and similar directional terms are not to be construed to limit the scope of the disclosure. Number designations, such as first or second, are also not limiting and may be interchanged in light of the description.

While the disclosure may be illustrated with respect to specific applications or industries, those skilled in the art will recognize the broader applicability of the disclosure. Those having ordinary skill in the art will recognize that terms such as "above," "below," "upward," "downward," et cetera, are used descriptively of the figures, and do not represent limitations on the scope of the disclosure, as defined by the appended claims. Any numerical designations, such as "first" or "second" are illustrative only and are not intended to limit the scope of the disclosure in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

When used herein, the term "substantially" refers to relationships that are, ideally perfect or complete, but where manufacturing realties prevent absolute perfection. Therefore, substantially denotes typical variance from perfection. For example, if height A is substantially equal to height B, it may be preferred that the two heights are 100.0% equivalent, but manufacturing realities likely result in the distances varying from such perfection. Skilled artisans would recognize the amount of acceptable variance. For example, and without limitation, coverages, areas, or distances may generally be within 10% of perfection for substantial equivalence. Similarly, relative alignments, such as parallel or perpendicular, may generally be considered to be within 5%.

The vehicle 10 in FIG. 1 is positioned relative to a road surface (not shown). The vehicle 10 includes a first end or front end 16, an opposing second end or rear end 18, a first lateral portion or left side 20 generally extending between the first and second ends 16, 18, and an opposing second lateral portion or right side 22. The vehicle body 14 further includes a top body portion 24, which may include at least a vehicle roof portion, and an opposing lower body portion or underbody 26. A passenger compartment 28 is defined in the vehicle body 14. As understood by those skilled in the art, the first or front end 16 may face oncoming ambient airflow 30 when the vehicle 10 is in motion relative to the road surface. Each of the left side, right side, top, and underbody body sections, 20, 22, 24, and 26, respectively, spans between the front and rear ends 16, 18 of the body 14.

The vehicle 10 includes one or more wheels arranged between the first and second ends 16, 18, proximate the left and right sides 20, 22. The one or more wheels includes a first set of wheels 36 disposed proximate the first or front end 16 of the vehicle 10 and a second set of one or more wheels 38 disposed proximate the second or rear end 18 of the vehicle 10. As shown in FIG. 1, the first set of one or more wheels 36 may be a pair of front wheels that are rotatably connected to the vehicle 10 and the second set of one or more wheels 38 may be a pair of rear wheels that are rotatably connected to the vehicle 10.

The vehicle body 14 defines a compartment 46 for housing a powertrain 40. The powertrain 40 may include an internal combustion engine for generating engine torque and a transmission operatively connecting the engine to at least some of the road wheels 36, 38 for transmitting engine torque thereto. For an electric or hybrid vehicle, the powertrain 40 may include one or more motor-generators, none of which are shown, but the existence of which can be appreciated by those skilled in the art. However, it is understood that the compartment 46 may be configured as a storage compartment or other vehicle space if the powertrain 40 of the vehicle 10 is positioned in a central or rear portion of the vehicle 10.

As shown, the vehicle body 14 also includes a vehicle fascia 48 arranged at the front end 16. The fascia 48 defines at least one opening, such as a grille, receiving at least some of the oncoming ambient airflow 30, which may be used for cooling the powertrain 40. Generally, the at least one opening is provided in the front end 16 of the vehicle 10, as well as various protruding features on the surface of the vehicle body 14, tend to impact the vehicle's 10 aerodynamic signature. Nothing precludes the vehicle 10 from having a greater number of grille openings for admitting ambient airflow 30 into the compartment 46 from the ambient atmosphere.

The vehicle 10 also includes a bonnet or hood panel 52 adjustably mounted to the vehicle body 14 and movable between at least one open position where the hood panel 52 is unfastened from the vehicle body 14 to provide access to the compartment 46 and a closed position wherein the hood panel 52 extends at least partially above and across to cover the compartment 46 to restrict access to the compartment 46. The hood panel 52 may be pivotally mounted to one or more load-bearing members of the body 14 to provide access to, and securely close, the top portion of the compartment 46.

The vehicle 10 may also include a vehicle roof, generally at or along the top surface 24, and a trunk lid 58. Corresponding to the specifically shown front-engine configuration of the vehicle 10, the hood panel 52 is depicted as arranged generally proximate the front end 16, while the trunk lid 58 is arranged generally proximate the rear end 18 of the vehicle body 14 of the vehicle 10.

The vehicle 10 is equipped with a latch and lock system that employs a concealed hood latch or latching mechanism 100 movable between a latched position to secure the hood panel 52 in a closed position relative to the vehicle body 14, as shown in FIG. 1, and at least one unlatched or actuated position. It is contemplated that the latching mechanism 100 is mounted to the front or forward portion of the vehicle 10 when the hood panel 52 opens from the forward portion of the vehicle 10. The latching mechanism 100 cooperates with the hood panel 52 to secure the hood panel 52 proximate to the compartment 46 in the vehicle body 14. Further, it is contemplated that the latching mechanism 100 of the present disclosure may be configured for use without an external handle or member cooperating with the latching mechanism 100 to releasably secure the hood panel 52 to the latching mechanism 100 and, thereby, the hood panel 52 to the vehicle 10.

Figure 2A:
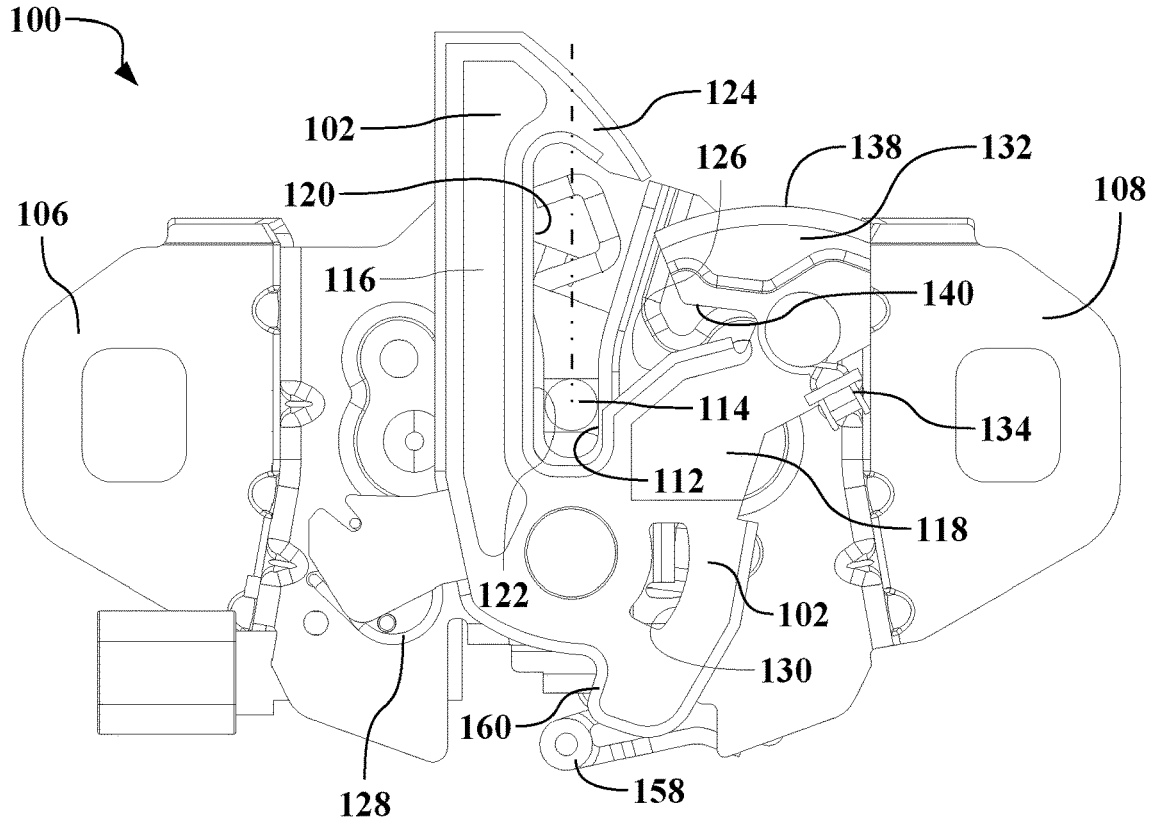
FIGS. 2A and 2B are schematic front and rear views of a latching mechanism in a fully latched position.

Referring to FIGS. 2A-7C, there are shown various views, or portions, of the latching mechanism 100 in various states of operation relative to the hood panel 52. Each of the A/B pairs of figures is shown from opposing view points, such that clockwise rotation of a component in FIG. 2A is counterclockwise rotation of the same component in FIG. 2B. FIGS. 2A and 2B illustrate the latching mechanism 100 in a fully latched position, and other states will be explained relative to the other figures.

While the latching mechanism 100 is illustrated in one non-limiting configuration, it is understood that the latching mechanism 100 may be installed in a variety of positions and arrangements depending upon the configuration of the vehicle 10. For example, the front or forward view may be reversed with the rear or rearward views such that the latching mechanism 100 may be mounted to either the front or the rear of a tie bar structure. Further, the latching mechanism 100 may be configured for use in right hand drive and left-hand drive vehicle configurations in order to dictate the cable going to a driver's side of the vehicle 10. Additionally, the latching mechanism 100 may use different part configurations than those illustrated.

Figure 2B:
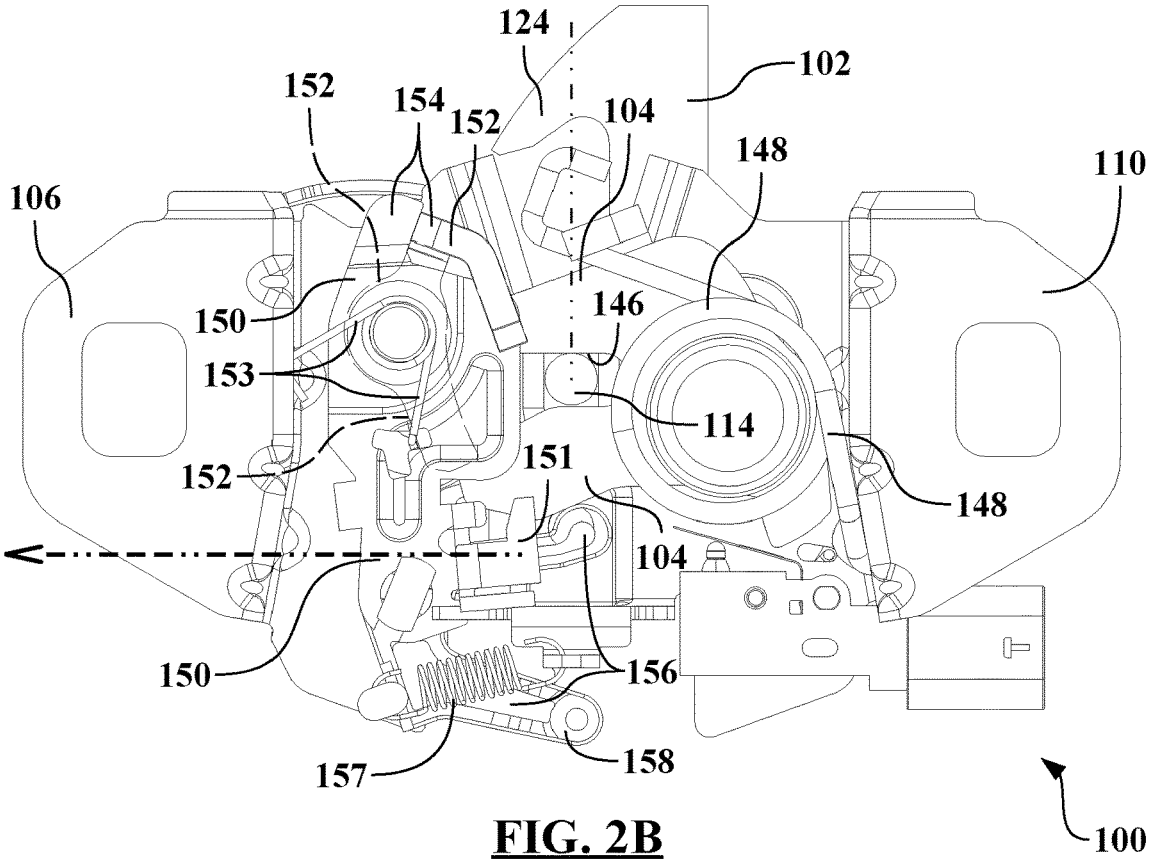

Referring to FIGS. 2A and 2B, the latching mechanism 100 includes a secondary catch 102 and a fork bolt 104, both of which are pivotally or rotatably connected to a housing 106 via fasteners, such as rivets, bolts, or the like. In the configuration shown, the fork bolt 104 is a single-position fork bolt, as opposed to dual position.

The housing 106 is in turn mounted to a portion of the vehicle body 14. The housing 106 illustrated in the figures includes a first side 108 (viewable in FIG. 2A) and an opposing second side 110 (viewable in FIG. 2B). The first side 108 of the housing 106 has the secondary catch 102 pivotally connected thereto and the second side 110 has the fork bolt 104 pivotally connected thereto. Note that the housing 106 may be alternatively configured. For example, and without limitation, the first side 108 and the second side 110 may be portions of a box frame that surrounds the remainder of the latching mechanism 100, such that the components are interior to the first side 108 and the second side 110. Some configurations may have all components attached to the same side of the housing 106.

The housing 106 further includes a housing cam surface extending between the first side 108 and second side 110 in a central region of the housing 106 defining a striker channel 112, which defines a striker path or striker direction. The striker channel 112 is configured to receive and guide a striker 114 therethrough. As would be recognized by skilled artisans, the striker 114 is fixedly and rigidly attached to the hood panel 52, which is not shown in FIGS. 2A-7C.

The secondary catch 102 includes a first lever arm 116 and a second lever arm 118, which extends from the first lever arm 116 at an acute angle—i.e., an angle of less than 90-degrees. A latch side surface 120 extends along the first lever arm 116 and the second lever arm 118. The latch side surface 120 defines a primary catch portion 122 between the intersection of the first lever arm 116 and the second lever arm 118, and extends to a secondary hook portion 124 on the first lever arm 116 facing the primary catch portion 122. The secondary hook portion 124 is formed along a hook-shaped portion of the first lever arm 116.

The primary catch portion 122 is defined adjacent the striker channel 112 in the central region of the housing 106 and may be selectively aligned therewith. The secondary hook portion 124 is defined along the first lever arm 116 and is configured to extend above an upper portion of the housing 106. The latch side surface 120 further defines a latch cam surface 126 on the second lever arm 118. The latch cam surface 126 is configured such that a force applied along the striker path onto the latch cam surface 126 causes the secondary catch 102 to rotate such that the primary catch portion 122 and the second catch portion are aligned with the striker channel 112 along the striker path.

The latching mechanism 100 may include a catch biasing member, which may be referred to as a first biasing member 128, such as an over-center spring or the like, operating bi-directionally and applying a force to selectively preload the secondary catch 102 to rotate in opposing directions, depending on the position of the secondary catch 102. The first biasing member 128 may also be that of torsional toggle spring, a pin acting on a bent leaf spring that compresses against the pin going over a hump in the middle, other extension/compression springs that have a similar over-center characteristic, or any combination thereof. Note that the first biasing member 128, in addition to other biasing members described herein, may not be shown in all of the figures, in order to better illustrate interactions between, and movements of, other components.

The first biasing member 128 may be configured bi-directionally such that, depending on the position of the secondary catch 102, the force of the first biasing member 128 may be applied in one direction, or another, opposite direction. For example, as shown in FIG. 2A the force of the first biasing member 128 is applied in a first, clockwise, direction (as viewed in FIG. 2A) to maintain the primary catch portion 122 in a latched position and the secondary hook portion 124 above the striker 114 to retain closure of the hood panel 52. This may be referred to as a first position of the secondary catch 102, where the primary catch portion 122 and the secondary hook portion 124 are aligned with the striker channel 112 along the striker path.

Figure 5A:
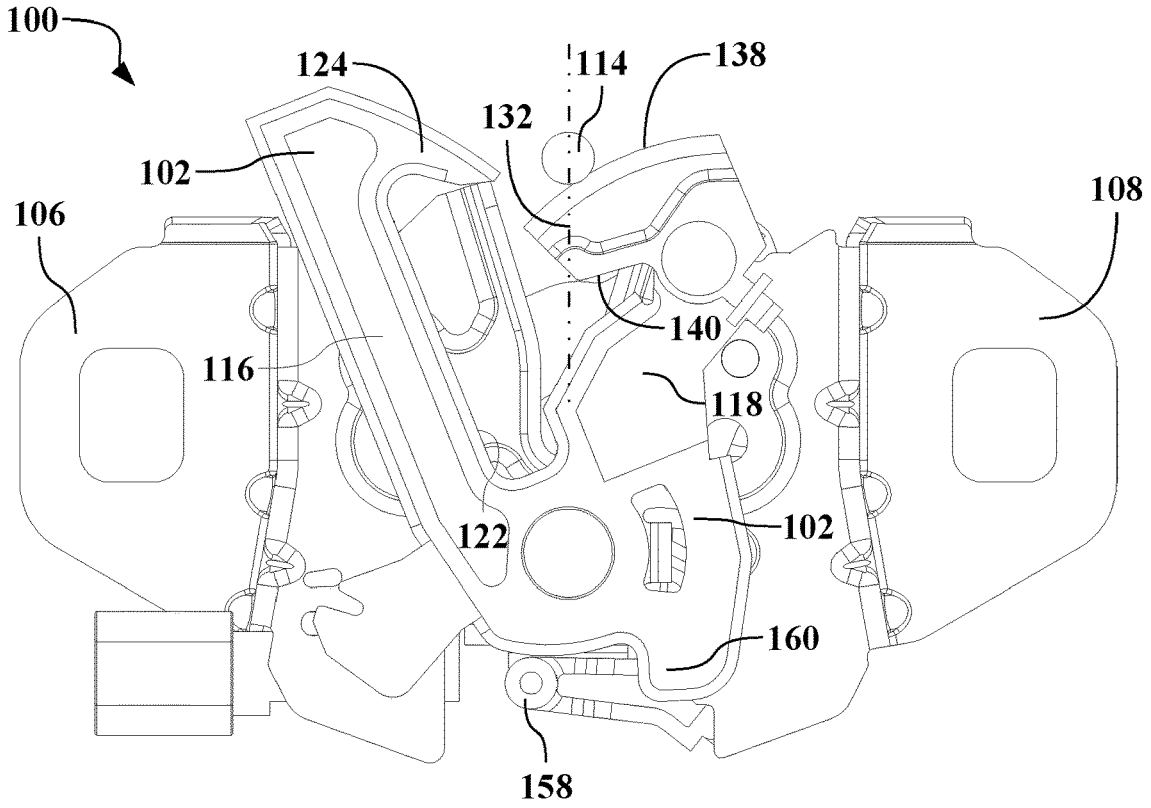
FIGS. 5A and 5B are schematic front and rear views of the latching mechanism transitioning from the fully actuated position toward the secondary position.

Also, as shown in FIG. 5A, the force of the first biasing member 128 is applied in a second, counterclockwise, direction (as viewed in FIG. 5A) to maintain both the primary catch portion 122 and the secondary hook portion 124 in an unlatched position spaced apart from the striker path of the striker 114. This may be referred to as a second position of the secondary catch 102, where the primary catch portion 122 and the secondary hook portion 124 are not aligned with the striker channel 112 along the striker path. Therefore, the secondary catch 102 operates bi-directionally, or as an over-center mechanism, and biases itself toward the two different states shown in the figures.

Referring again to FIGS. 2A and 2B, the latching mechanism 100 may also include a limiter or limiter tab (not numbered) configured to travel in a slot 130 defining a range of motion for the secondary catch 102. The limiter may cooperate with, and extend, from the housing 106 or may be a distinct component of the latching mechanism 100. The slot 130 may be formed in a portion of the latching mechanism 100 and may be formed in a variety of geometries and positions. In one non-limiting example, slot 130 may be arcuate in shape configured to define a predetermined amount of rotation for the secondary catch 102 relative to a pivot center therein. The slot 130 may be sized to allow the limiter to travel therein and thereby, limit the range of motion of the limiter within the geometry defining the slot 130.

The latching mechanism 100 further includes a cancel lever 132 pivotally mounted to an end of the second lever arm 118 of the secondary catch 102, spaced apart from the primary catch portion 122. The cancel lever 132 has a cancel biasing member, which may be referred to as a second biasing member 134, such as a bi-directional spring, operatively attached thereto and urging the cancel lever 132 to selectively rotate in either a first direction or a second direction. The cancel lever 132 is shown substantially at the center, or zero, point of the second biasing member 134 in FIGS. 2A and 2B. Rotation in the first direction causes the arm of the cancel lever 132 to engage the second lever arm 118—i.e., to rotate counterclockwise (as viewed in FIG. 2A), and rotation in the second direction causes the arm of the cancel lever 132 to move upward and away from the second lever arm 118—i.e., to rotate clockwise (as viewed in FIG. 2A).

The cancel lever 132 has an exterior cam surface 138 transitioning through an apex to a first interior cam surface 140. The first interior cam surface 140 faces in a direction away from the exterior cam surface 138 and both are along a single arm, tab, or extension of the cancel lever 132. Note that the cancel lever 132 has only one arm or tab, as opposed to two arms or projections extending from the attachment and pivot point.

As best viewed in FIG. 2B, the fork bolt 104 defines a fork bolt channel 146 configured to receive and secure the striker 114 in the latched position to fasten the hood panel 52 to the vehicle body 14. The fork bolt 104 is positioned on the housing 106 such that the fork bolt 104 and fork bolt channel 146 are disposed proximate the striker channel 112.

In one non-limiting embodiment, the fork bolt 104 is pivotally connected to the housing 106 on the opposing surface from the secondary catch 102. The fork bolt 104 is movable between a locked position in which the fork bolt channel 146 of the fork bolt 104 secures the striker 114 to fasten the hood panel 52 to the vehicle body 14, and an unlocked position allowing the striker 114 to be released from the fork bolt channel 146. The fork bolt 104 selectively secures the striker 114 by preventing movement of the striker 114 within the striker channel 112 of the housing 106, as shown in FIGS. 2A and 2B.

The latching mechanism 100 may additionally include a fork bolt biasing member, which may be referred to as a third biasing member 148, that may be a clock spring or the like, operatively connected to the fork bolt 104 to allow the fork bolt 104 to selectively rotate relative to the housing 106. The third biasing member 148 may apply a preload force directed to bias the fork bolt 104 to rotate clockwise (as viewed in FIG. 2B) from the locked position, shown in FIG. 2B, to the unlocked position, as shown in FIGS. 3B, 4B, 5B, and 6B, and explained in more detail herein. In the unlocked position, the fork bolt 104 releases the striker 114 to move within the striker channel 112 and permits the hood panel 52 to move relative to the housing 106 and the vehicle body 14.

An operating lever or release lever 150 is pivotally or rotatably attached to the housing 106. The release lever 150 has an actuation point 151 formed thereon or attached thereto. The actuation point 151 may interact with a cable or other device (not shown, but the tensile force exerted thereby is shown by an arrow in FIG. 2B) configured to apply substantially linear force thereto.

A detent 152 is also pivotally or rotatably attached to the housing 106. Note that much of the detent 152 is hidden from view in the figures by the release lever 150. Therefore, most of the figures show relevant portions of the detent 152 as dashed lines. However, FIG. 7C shows the detent 152 from the front view, with the housing 106 and the components on the first side 108 hidden from view.

The detent 152 is pivotally connected to the housing 106 at substantially the same pivot point as the release lever 150, and the release lever 150 is configured to selectively control rotation of the detent 152 to releasably engage the fork bolt 104, as explained herein. A detent biasing member, which may be referred to as a fourth biasing member 153, may be provided to cooperate with the release lever 150 and the detent 152. The fourth biasing member 153 may be a spring or the like that may apply a force to at least a portion of the detent 152 relative to the release lever 150.

A pair of detent tabs 154 are formed on the release lever 150 and the detent 152, and are shown in contact with one another. The detent tabs 154 cooperate to selectively prevent movement of the detent 152 relative to the release lever 150, such that the detent 152 is allowed to move clockwise (as viewed in FIG. 2B) relative to the release lever 150 but is not allowed to counterclockwise (as viewed in FIG. 2B) when the detent tabs 154 are in contact. Therefore, the detent 152 is movable with lost motion relative to the release lever 150, such that the detent 152 is only movable to separate the detent tabs 154 with initial clockwise (as viewed in FIG. 2B) rotation relative to the release lever 150.

The fourth biasing member 153 biases the detent 152 in the counterclockwise direction (as viewed in FIG. 2B) relative to the release lever 150, such that the fourth biasing member 153 tries to maintain contact between the detent tabs 154. A double-pull lever 156 is pivotally connected to the release lever 150, at generally the opposite end from the detent 152 and the detent tabs 154. A release biasing member, which may be referred to as a fifth biasing member 157, is operatively attached to the release lever, the double-pull lever 156, and the housing 106. The fifth biasing member 157 may be a spring, or similar mechanism, configured to bias the double-pull lever 156 counterclockwise (as viewed in FIG. 2B) relative to the release lever 150.

The fifth biasing member 157 also biases the release lever 150 counterclockwise (as viewed in FIG. 2B) to return the release lever 150 to the position shown in FIG. 2B after being pulled. Note that some configurations of the latching mechanism 100 may use two separate biasing members to provide the function of the fifth biasing member 157.

In a mechanical system architecture, pulling on a hood latch release mechanism—such as a release lever (not shown) within the passenger compartment 28—that cooperates with the release lever 150 will apply a tensile force to a hood latch release cable (not shown, the tensile force is illustrated by an arrow) attached to the actuation point 151. The release cable may be, for example and without limitation, a Bowden-type cable. The release cable moves the actuation point 151 leftward (as viewed in FIG. 2B), which causes clockwise rotation (as viewed in FIG. 2B) of the release lever 150. As a result, the release lever 150 actuates the latching mechanism 100 to partially unlatch the striker 114, thereby allowing the hood panel 52 to be moved, eventually, to an open position, as shown in FIGS. 3A and 3B.

Other mounting and latching architectures, including mechanical, electrical, and electro-mechanical configurations, are envisioned as being within the scope of this disclosure. For instance, the release cable may be representative of a solenoid controlled by an electrical wire harness or fiber optic cable in applications where the hood latching mechanism 100 is embodied as a power hood latch.

Figure 3A:
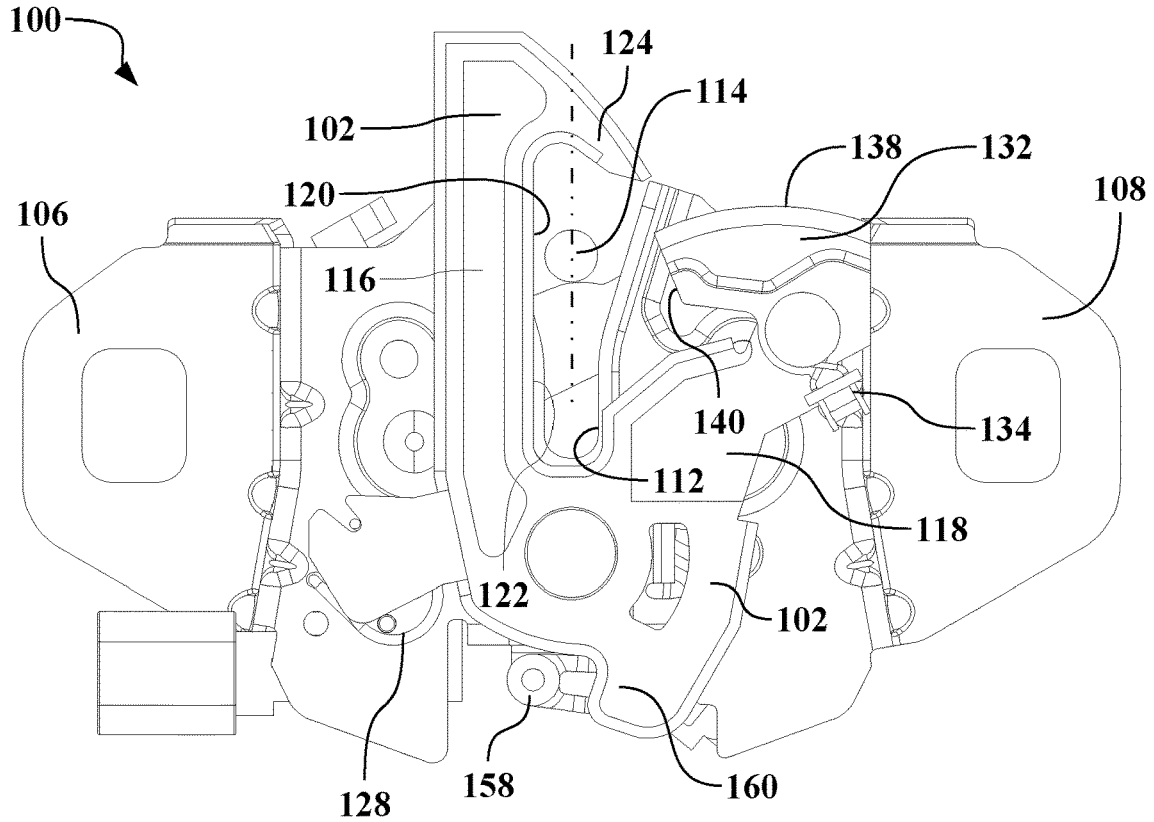
FIGS. 3A and 3B are schematic front and rear views of the latching mechanism in a secondary position.
Figure 3B:
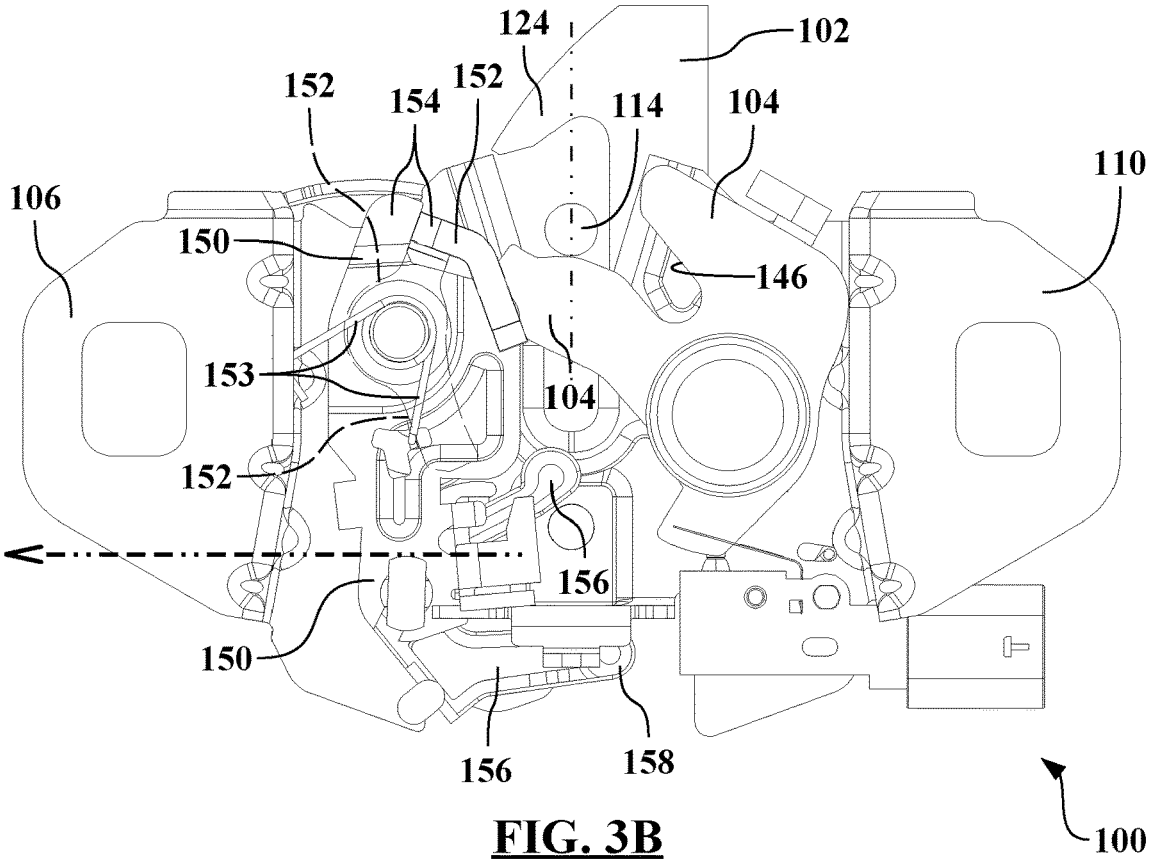
Figure 4A:
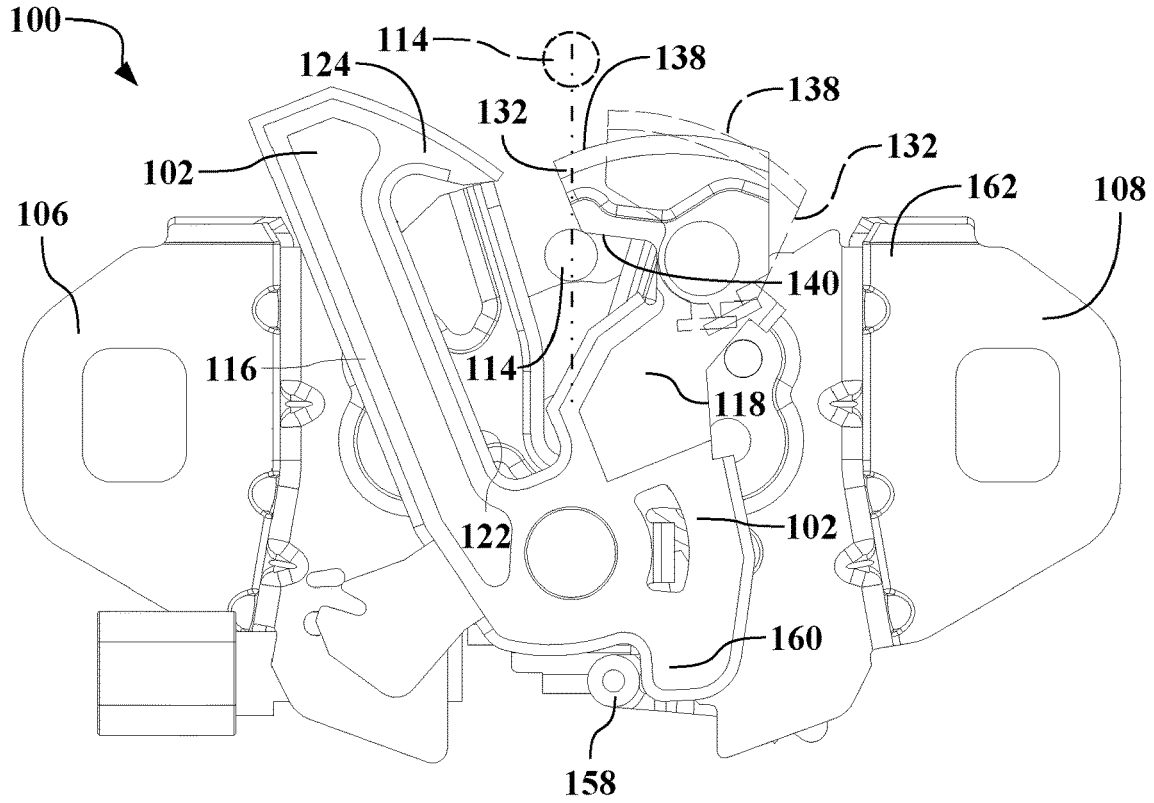
FIGS. 4A and 4B are schematic front and rear views of the latching mechanism transitioning from the secondary position to a fully actuated position.
Figure 4B:
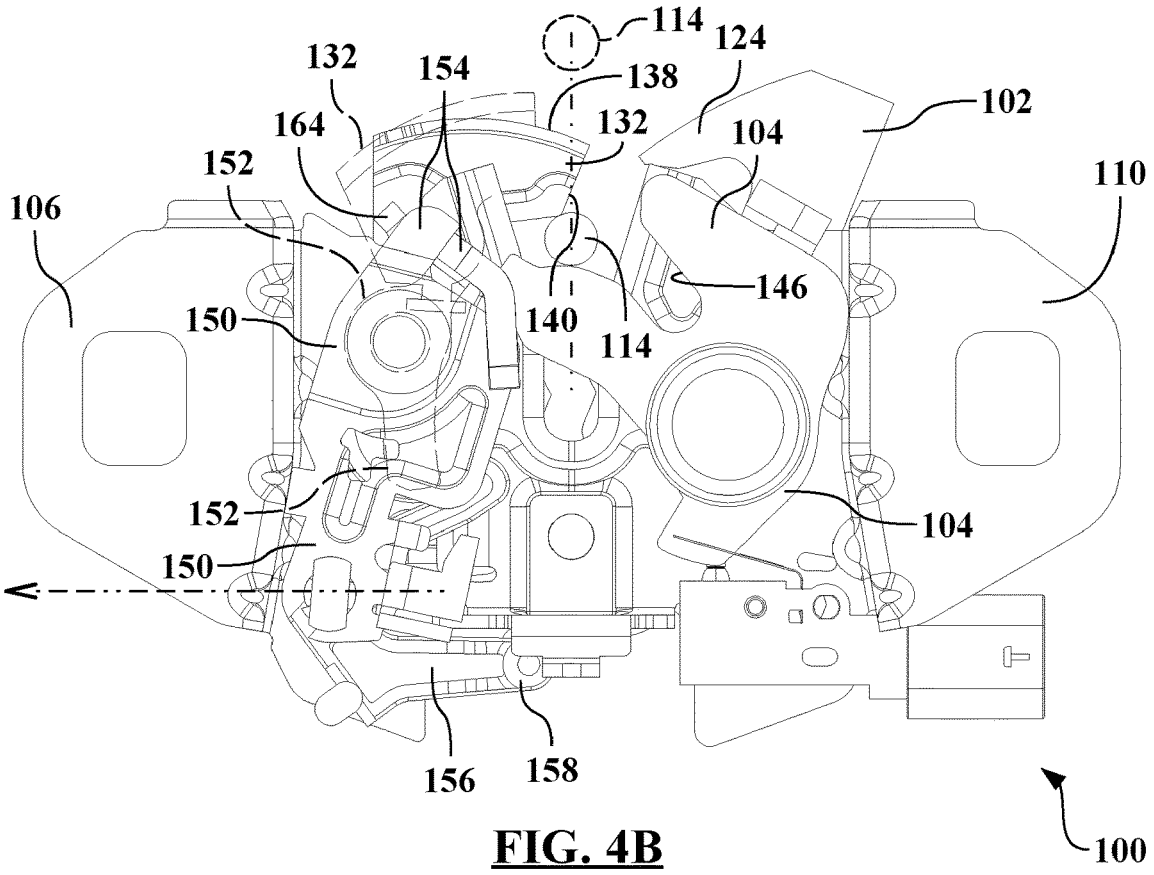

In a dual-actuated or dual-pull system, such as that shown in the figures, a first pull of the release cable places the latching mechanism 100 in a secondary position, as shown in FIGS. 3A and 3B. In the secondary position, the striker 114 is released from the fork bolt 104, but cooperates with the secondary catch 102 to maintain the hood panel 52 within a predetermined distance from the vehicle body. A second pull of the release cable places the latching mechanism 100 in a fully actuated position where the secondary hook portion 124 of the secondary catch 102 pivots away from the striker path, as shown in FIGS. 4A and 4B. The different positions will be explained in more detail below.

In the fully actuated position, the hood panel 52 may be manually lifted away from the vehicle body, as shown by the dashed striker 114 in FIGS. 4A and 4B, which may be referred to as a fully released position, as the hood panel 52 is substantially unrestrained by the latching mechanism 100. Therefore, the latching mechanism 100 has three states or positions: the fully latched position, in which the striker 114 and the hood panel 52 are fixed relative to the latching mechanism 100; the secondary position, in which the first pull of the release cable allows the striker 114 and the hood panel 52 to move within to the latching mechanism 100, but not to be released therefrom; and a fully actuated position, in which the second pull of the release cable allows the striker 114 and the hood panel 52 to separate or release from the latching mechanism 100.

The figures will now be explained in more detail relative to various states of actuation of the latching mechanism 100. The figures are representative of different states of the latching mechanism 100, but do not illustrate all components, or all relative movements or interactions between components. Some of the figures may be reordered, depending on how the latching mechanism 100 and the hood panel 52 are operated, and the order of figures shown is not limiting.

FIGS. 2A and 2B illustrate the latching mechanism 100 in the fully latched position. In the fully latched position, the primary catch portion 122 of the secondary catch 102 is configured to cooperate with the fork bolt 104 to facilitate or maintain closure of the under-hood compartment 46 via the striker 114, which is attached to the hood panel 52.

The fork bolt 104 is biased by the third biasing member 148 to rotate clockwise (as viewed in FIG. 2B). However, while in the fully latched position, the fork bolt 104 is prevented from rotation by interaction with a lower portion of the detent 152. Note that interaction of the fork bolt 104 and the detent 152 is hidden from the view of FIG. 2B by the release lever 150.

FIGS. 3A and 3B show the latching mechanism 100 in the secondary position. To move the latching mechanism 100 from the fully latched position, shown in FIGS. 2A and 2B, to the secondary position, the release lever 150 may be rotated clockwise (as viewed in FIGS. 2B and 3B) by the release cable or other mechanism, to release the fork bolt 104 from engagement with the detent 152.

As the release lever 150 is rotated clockwise (as viewed in FIGS. 2B and 3B) against the bias of the fourth biasing member 153, the detent 152 is also rotated away from the fork bolt 104 by cooperation of the detent tabs 154. As shown in FIG. 3B, the third biasing member 148 is then free to rotate the fork bolt 104 clockwise (as viewed in FIGS. 2B and 3B), which releases the striker 114 to move upward along the striker path, as shown in FIGS. 3A and 3B. Note that the upward movement of the striker 114 may be caused by springs or other biasing elements acting on the hood panel 52, in addition to the force exerted by the third biasing member 148 on the fork bolt 104. Actuation of the fork bolt 104 by the release lever 150 allows the striker 114 to be moved from the fork bolt 104 and adjusted from the fully latched position to the secondary position.

The double-pull lever 156 includes a projection 158 extending integrally from a surface of the double-pull lever 156. The projection 158 is configured to selectively engage a lower projection or lower surface 160 of the secondary catch 102 as shown FIG. 3A.

As shown in FIGS. 3A and 3B, in response to movement of the fork bolt 104, the fourth biasing member 153 is able to rotate the double-pull lever 156, such that the projection 158 on double-pull lever 156 is moved proximate to the lower surface 160 of the secondary catch 102. Comparing FIG. 2A to FIG. 3A, the double-pull lever 156 has rotated clockwise as a result of the release lever 150 disengaging the fork bolt 104.

The latching mechanism 100 is shown in FIGS. 3A and 3B in the secondary position. The secondary catch 102 is configured such that the secondary hook portion 124 generally overhangs a central region of the latching mechanism 100 along the striker path. Therefore, the striker 114 is not able to continue upward, and the hood panel 52 cannot be completely opened upward. However, the striker 114 may move into contact with the secondary catch 102, such that the secondary hook portion 124 may also provide physical feedback to indicate completion of the movement to the secondary position. The operator within the vehicle 10 may then release the lever, which ends the first pull and returns the latching mechanism to the state shown in FIGS. 3A and 3B. The fork bolt 104 and the secondary catch 102 cooperate to define the secondary position (as well as the other positions) of the latching mechanism 100.

After releasing the fork bolt 104, and no longer under the force of the release cable, the release lever 150 may move back to substantially its original position under the bias of the fourth biasing member 153, as shown in FIGS. 3A and 3B. As the release lever 150 is repositioned, the double-pull lever 156 translates and rotates such that the projection 158 of double-pull lever 156 is placed substantially into alignment with the lower surface 160 of the secondary catch 102.

FIGS. 4A and 4B show the latching mechanism 100 transitioning to the fully actuated position, as a result of a second pull on the release cable. In the transition from the secondary position, as shown in FIGS. 3A and 3B, to the fully actuated position, as illustrated in FIGS. 4A and 4B and FIGS. 5A and 5B, the double-pull lever 156 cooperates with the release lever 150, such that the projection 158 engages the lower surface 160 of the secondary catch 102.

The release lever 150 is shown in FIG. 4B during the second pull on the release cable (illustrated as a dashed arrow). As the release lever 150 is actuated by the second pull, the projection 158 of the double-pull lever 156 engages the lower surface 160 of the secondary catch 102 and rotates the secondary catch 102 from the secondary position to the fully actuated position. As viewed in FIG. 4A, the secondary catch rotates counterclockwise under the force from the projection 158 of the double-pull lever 156. As shown in FIG. 4B, the release lever 150 and the secondary catch 102 rotate clockwise.

Figure 5B:
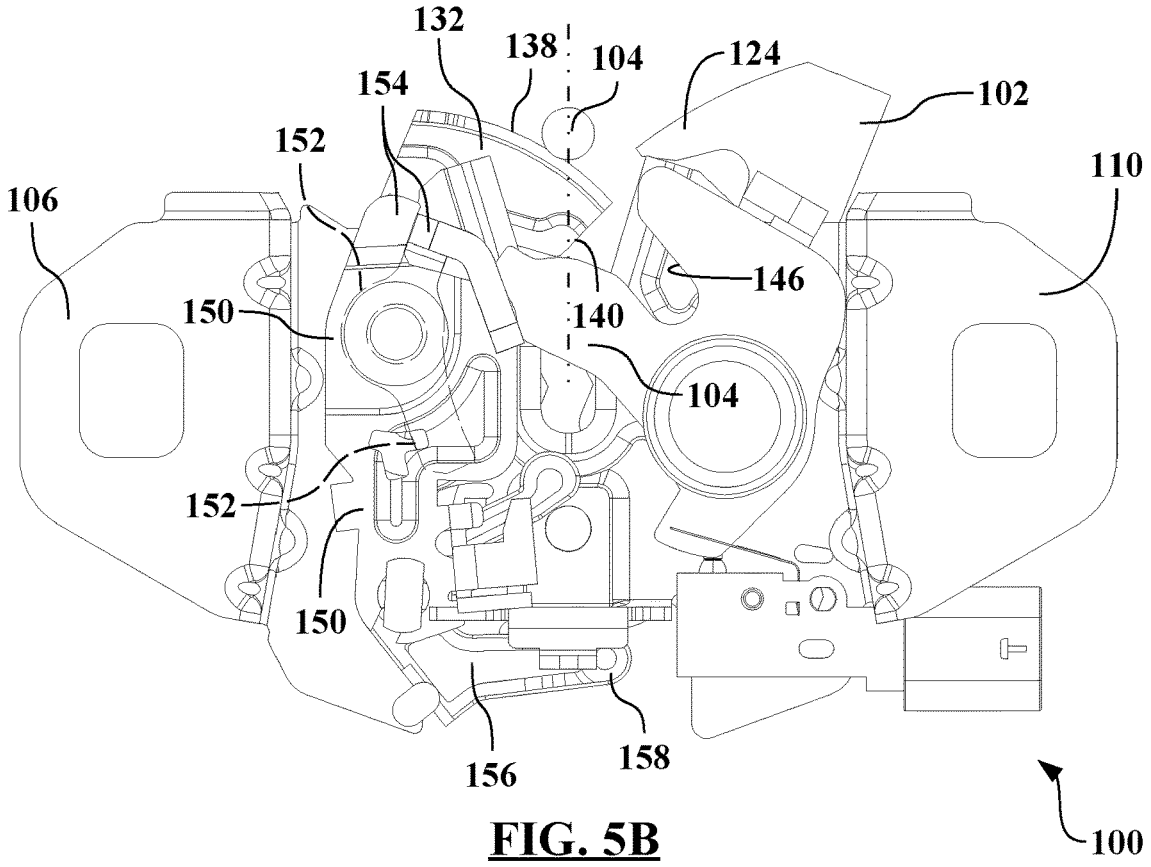

Therefore, in response to the second pull or actuation of the release lever 150, the secondary catch 102 is selectively rotated or translated relative to the housing 106 such that the secondary hook portion 124 is translated away from its previous position adjacent the striker path. Following the second pull of the release cable, the release lever 150 will return to its base position, which is shown in FIGS. 3B and 5B.

As the secondary catch 102 is rotated into the secondary position, the apex of the cancel lever 132 extends over the striker channel 112, such that the interior cam surface 140 of the cancel lever 132 overlaps the striker channel 112 as the secondary hook portion 124 of the latch member is rotated away from the striker channel 112. In other words, when the striker 114 is fully released from the fork bolt 104 it travels at least partially through the housing 106 proximate the striker channel 112 toward the cancel lever 132 and engages the lower cam surface 140 of the cancel lever 132.

The second biasing member 134 allows the cancel lever 132 to rotate clockwise (as viewed in FIG. 4A) when urged by the striker 114 along the interior cam surface 140 of the cancel lever 132. Therefore, the striker 114 is able to move upward (as shown with dashed lines) away from the housing 106 after rotating the cancel lever 132 clockwise (as also shown with dashed lines). At this point, the hood panel 52 may be manually lifted upward, causing the striker 114 to completely separate from the remainder of the latching mechanism 100.

The second biasing member 134 may be a bi-directional spring, such that it will return to the position shown in FIGS. 2A, 3A, and 4A, relative to the secondary catch 102, after the striker 114 moves upward beyond contact. However, dust and debris may limit functionality of the second biasing member 134, such that the cancel lever 132 may stick at the position shown in dashed lines. The latching mechanism 100 is configured to overcome the effects of dust and debris, as explained herein.

The limiter may be configured to travel in the slot 130 of secondary catch 102. The slot 130 defines the predetermined range of rotation for the secondary catch 102 relative to a pivot center, such that the first interior cam surface 140 obstructs the striker channel 112 to engage the striker 114.

The latching mechanism 100 in the fully actuated position, as shown in FIGS. 4A and 4B may be repositioned back into the fully latched position, as shown in FIGS. 2A and 2B, without the need to first fully release the striker 114 from the latching mechanism 100 by raising the striker 114 upward. This can be accomplished by manually pushing the hood panel 52 of the vehicle 10 into the closed position, causing the striker 114 to travel downward through the striker channel 112 to engage the latch cam surface 126 and then into the fork bolt channel 146, thereby causing both the secondary catch 102 and fork bolt 104 to rotate back into the fully latched position, as shown in FIGS. 2A and 2B.

FIGS. 5A and 5B and FIGS. 6A and 6B show the latching mechanism 100 with the striker 114 moving from the fully released position—apart from the latching mechanism 100, thus enabling the full opening of the hood panel 52—back toward the secondary position and the fully latched position. Referring to FIGS. 5A-6B, the exterior cam surface 138 of the cancel lever 132 is configured such that a force applied along the striker path onto the exterior cam surface 138 rotates the cancel lever 132 into contact with the second lever arm 118 of the secondary catch 102. The force from the striker 114, through the cancel lever 132, induces a moment onto the second lever arm 118 of the secondary catch 102, and the moment causes the secondary catch 102 to rotate in the clockwise direction (as viewed in FIGS. 5A and 6A).

Figure 6A:
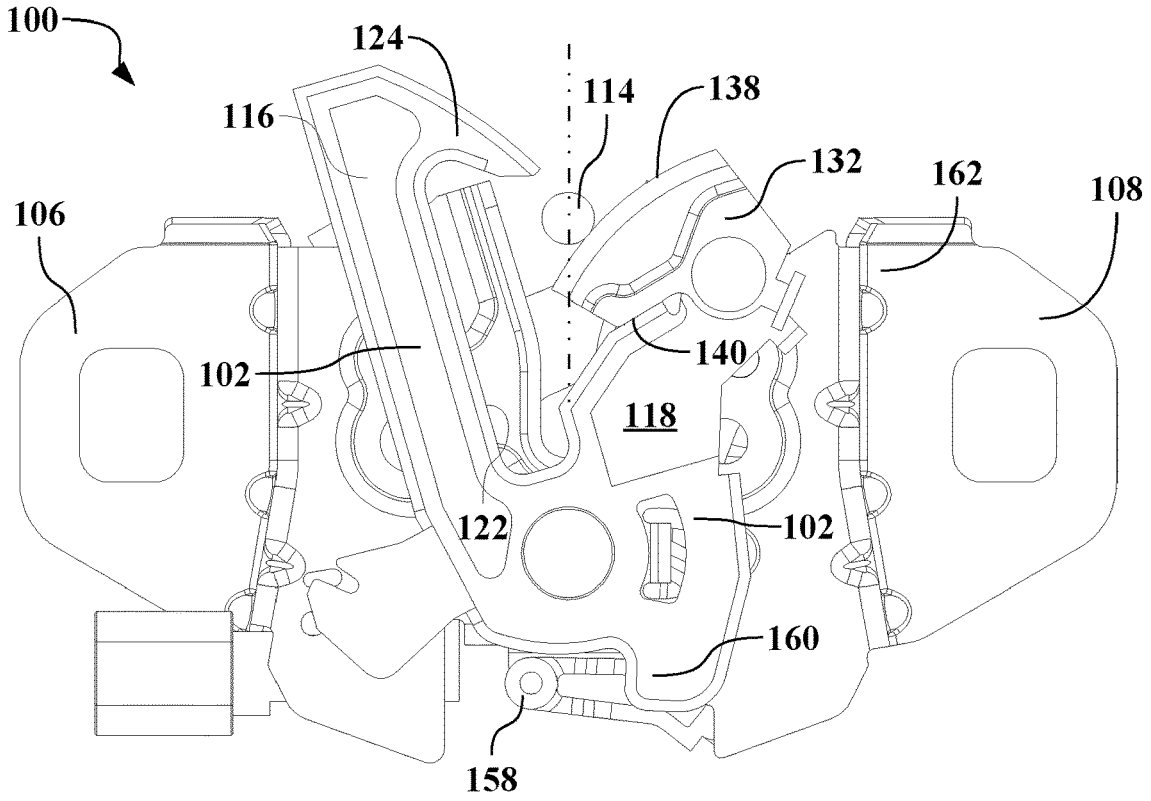
FIGS. 6A and 6B are schematic front and rear views of the latching mechanism transitioning from the fully actuated position toward the secondary position.
Figure 6B:
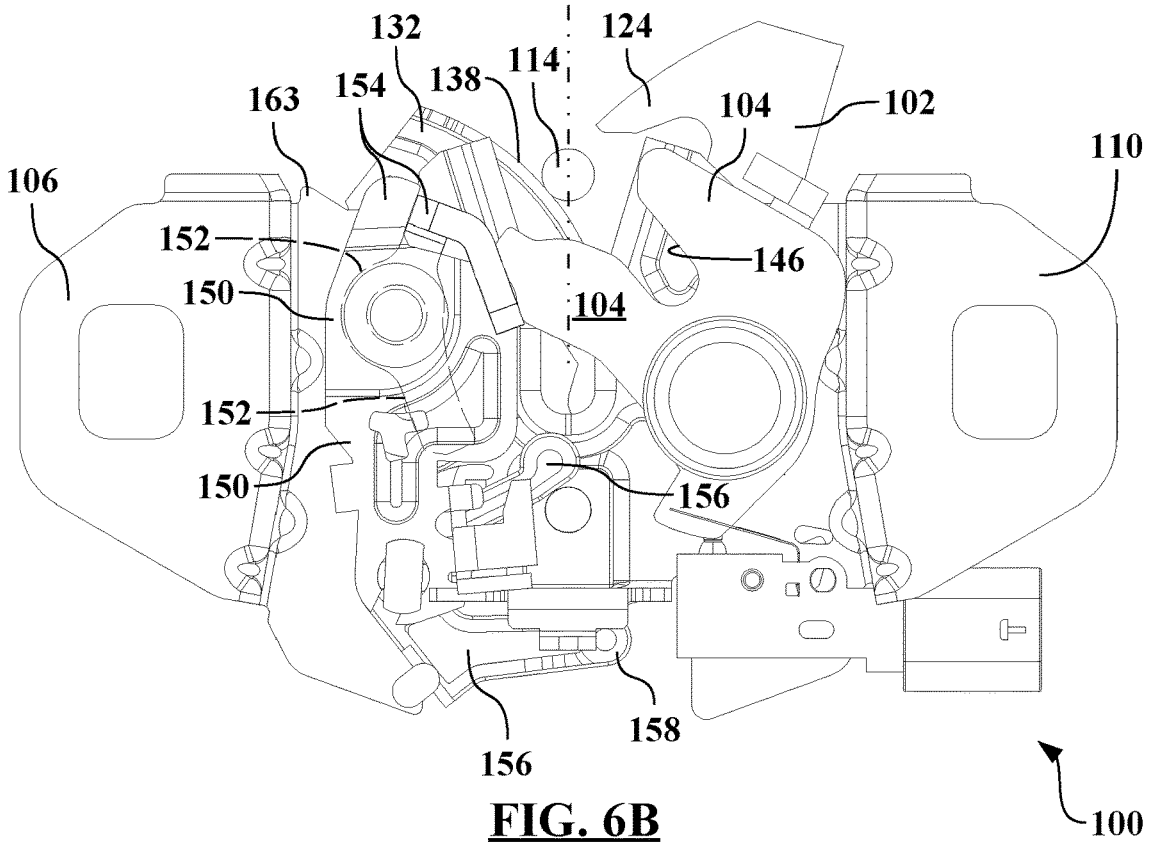

Comparison between FIGS. 5A and 5B and FIGS. 6A and 6B shows that as the hood panel 52 and the striker 114 are moved toward a position proximate the vehicle body 14, the striker 114 progressively engages the exterior cam surface 138 of the cancel lever 132. As the secondary catch 102 is rotated by the moment from the cancel lever 132, the secondary hook portion 124 is moved from its position away from the striker path, as shown in FIGS. 5A and 5B, to a position covering or blocking the striker path, as shown in FIGS. 6A and 6B. Therefore, after approximately the amount of downward travel shown in FIGS. 6A and 6B, the striker 114 is no longer able to move back upward and be fully released, such that the latching mechanism 100 is then back into the secondary position.

The clockwise moment (as viewed in FIGS. 5A and 6A) imposed by the cancel lever 132 on the secondary catch 102 also allows the latching mechanism 100 to close to the secondary position under its own weight, as opposed to requiring additional downward force, such as from a person leaning on the hood panel 52. The over-center spring of the first biasing member 128 (shown in FIG. 2A) further assists in bringing the secondary catch 102 into alignment with the striker channel 112, which reduces the amount of downward force needed to close the hood panel 52. Contrarily, many other dual pull hood release mechanisms are unable to engage their secondary catches under the weight of their respective hood panels, and require the operator to apply downward force on the hood panel.

Figure 7A:
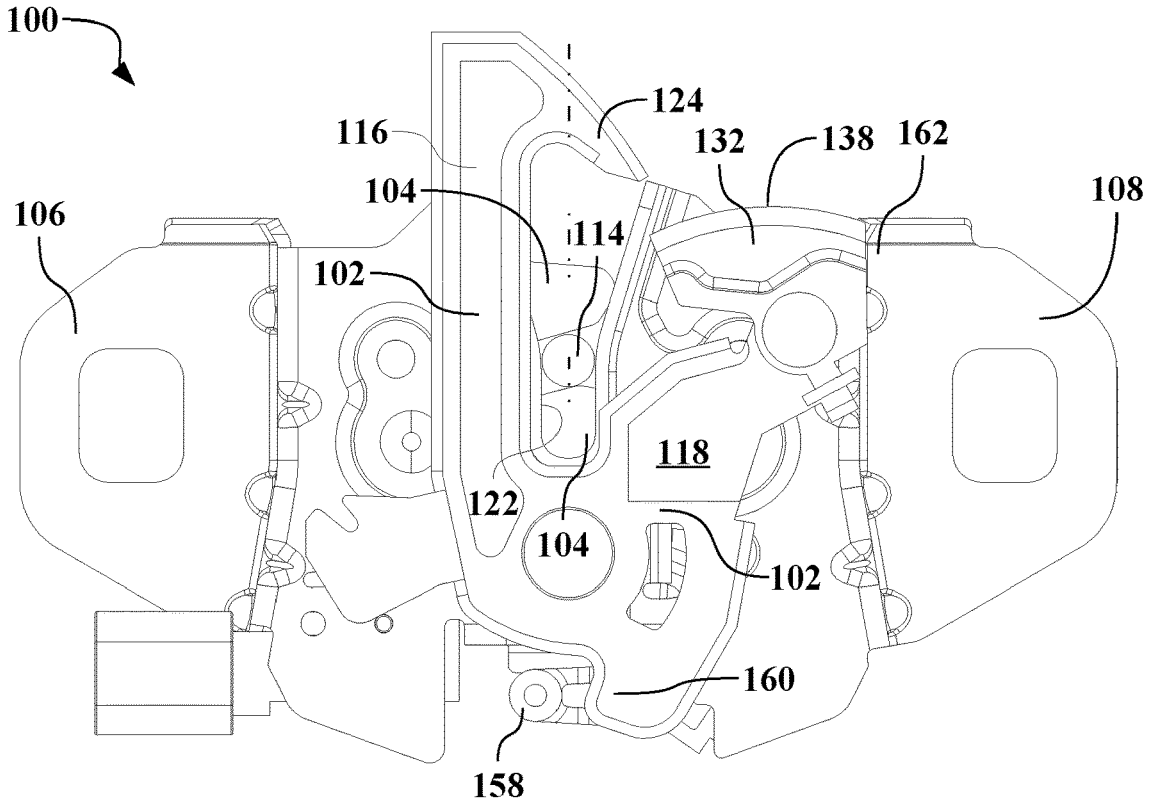
FIGS. 7A and 7B are schematic front and rear views of the latching mechanism transitioning from the secondary position to the fully latched position.
Figure 7B:
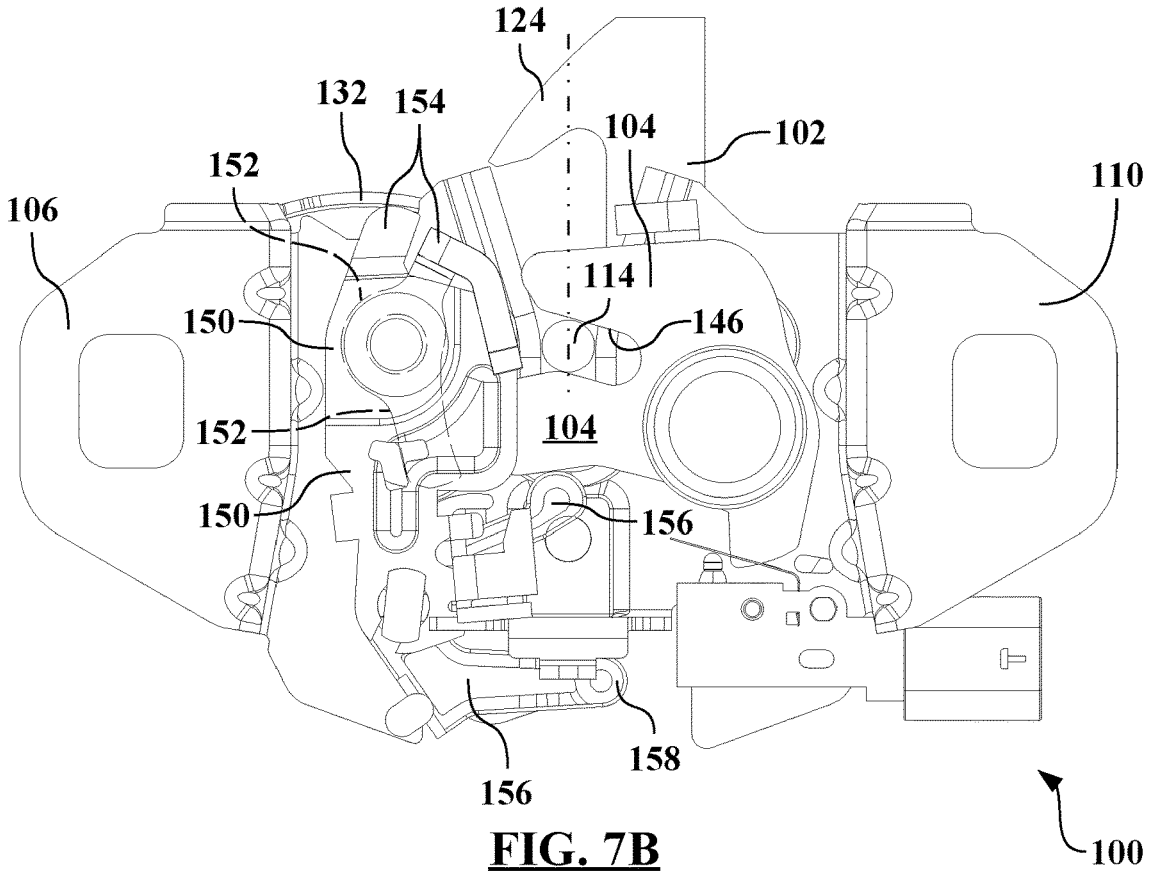
Figure 7C:
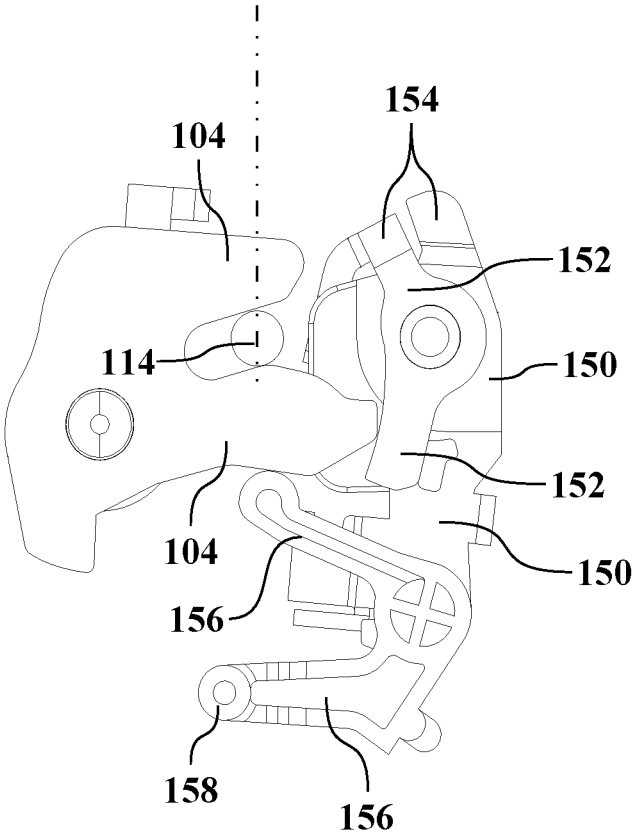
FIG. 7C is the same schematic front view of the latching mechanism as FIG. 7A, but with several components hidden to illustrate a lost motion interaction between a detent and a release lever caused by a fork bolt.

FIGS. 7A and 7B show the latching mechanism 100 transitioning from the secondary position back to the fully latched position. Note that a similar process would occur to move the latching mechanism 100 to the fully latched position from the secondary position shown FIGS. 3A and 3B, without first fully releasing the striker 114. FIG. 7C shows a similar front view to that of FIG. 7A, but with the housing 106 and all of the components on the first side 108 hidden from view to illustrate the lost motion movement of the detent 152 relative to the release lever 150 as the fork bolt 104 closes.

As the striker 114 moves beyond the cancel lever 132 and into the striker channel 112, the striker 114 enters the fork bolt channel 146 of the fork bolt 104. The striker 114 causes the fork bolt 104 to rotate counterclockwise (as viewed in FIG. 7B). The fork bolt 104 pushes the detent 152, such that the detent 152 rotates clockwise (as viewed in FIG. 7B) relative to the release lever 150. The detent 152 is allowed to rotate clockwise (as viewed in FIG. 7B) relative to the release lever 150, because the detent tabs 154 are separated, causing lost motion between the detent 152 and the release lever 150.

The lost motion is also viewable in FIG. 7C, where the fork bolt rotates the detent 152 counterclockwise (as viewed in FIG. 7C) relative to the release lever 150, thereby separating the detent tabs 154. The lost motion of the detent 152 means that the release lever 150 is not subject to loads or impacts as the latching mechanism 100 is returned to the fully latched position after the hood panel 152 had been opened or partially released to the secondary position.

As the fork bolt 104 continues to rotate, it will move passed the lower end of the detent 152 and be locked relative to the detent 152 and the release lever 150. The fork bolt 104 is then back at the fully latched position, as shown in FIGS. 2A and 2B.

Furthermore, note that rotation of the fork bolt 104 also pushes and rotates the double-pull lever 156 clockwise (as viewed in FIG. 7B), such that the projection 158 of the double-pull lever 156 will move below, and no longer engage the lower surface 160 of the secondary catch 102, as shown in FIGS. 2A and 2B. In FIG. 7C, the fork bolt 104 causes the double-pull lever 156 to rotate counterclockwise. This means that the release lever 150 and the double-pull lever 156 are reset and may move independently of the secondary catch 102, such that they are ready for another first pull of the release cable. Following the operational state shown in FIGS. 7A and 7B, the latching mechanism 100 generally returns to the state shown in FIGS. 2A and 2B.

In some situations, debris or dust may build up, resulting in the latching mechanism 100 having a faulted cancel lever 132. For example, when the latching mechanism 100 transitions from the secondary position, as shown in FIGS. 3A and 3B, to the fully actuated position, as shown in FIGS. 4A and 4B, the cancel lever 132 cancel lever may stick in the upwardly rotated position (shown by the dashed lines in FIGS. 4A and 4B). This results when the bi-directional second biasing member 134 is unable to overcome the limitations of the debris during an opening event for the hood panel 52—i.e., the cancel lever 132 is stuck in the second direction of rotation.

However, in that situation, the latching mechanism 100 is configured such that the striker 114 will contact the latch cam surface 126 of the secondary catch 102, causing the secondary catch 102 to rotate clockwise (as viewed in FIG. 4A) as the striker 114 moves toward the striker channel 112.

Therefore, the striker 114 will still be able to return to the striker channel 112 and the hood panel 52 will still be closeable, in spite of the stuck cancel lever 132.

Furthermore, when the striker 114 transitions the latching mechanism 100 from the secondary position to the fully latched position, as shown by comparison of FIGS. 6A and 6B and FIGS. 7A and 7B, a first knock-back projection 162 on the housing 106 rotates the cancel lever 132 substantially back to its zero position, such as that shown in FIG. 2A. Note that the striker 114 moving into the striker channel 112 will return the secondary catch 102 to its original position, via the latch cam surface 126, even if the secondary catch 102 also sticks due to debris. Furthermore, a second knock-back projection 163 may also contribute to rotating the cancel lever 132 back to its zero position.

In some instances, debris may fault movement of the cancel lever 132 and result in the interior cam surface 140 being stuck against the latch cam surface 126 after the striker 114 has advanced into the striker channel 112. This results when the bi-directional second biasing member 134 is unable to release the cancel lever 132 after a prior closing event—i.e., the cancel lever 132 is stuck in the first direction of rotation. In such a fault, the cancel lever 132 is positioned similarly to the view shown in FIG. 6A, after the striker 114 has moved back to the striker channel 112.

In this situation, a third knock-back projection 164—which is best viewed in FIG. 4B, and often hidden from view by the release lever 150—operates to rotate the cancel lever 132 counterclockwise (as viewed in FIGS. 4B and 6B). After the cancel lever 132 rotates to its zero position, as shown by the solid lines in FIGS. 4A and 4B, the striker 114 will contact a portion of the interior cam surface 140—because the apex of the cancel lever 132 extends into the striker path—and force the cancel lever 132 to rotate in the second direction, clockwise (as shown in FIG. 6A), as the striker 114 is subsequently raised through the striker channel 112.

The striker 114 will then be free to move upwardly in normal opening fashion. In many instances, either of the types of faulted cancel levers 132 described herein will may to normal operation after actuation of the latching mechanism 100, as the debris may be removed by movement and the bi-directional second biasing member 134 may be able to operate as planned.

The figures have been described, and are shown, in the order of a typical progression: a first pull of the release cable, to move from the fully latched position to the secondary position; a second pull of the release cable, to release to the fully actuated position; the hood panel 52 being fully opened; and then the hood panel 52 and the striker 114 being returned back to the fully latched position. However, this typical progression may not always occur, and the latching mechanism 100 is configured to move between the respective positions in different orders than that shown by progression of the figures.

For example, and without limitation, when the latching mechanism is the secondary position, such as the state shown in FIGS. 3A and 3B, the operator of the vehicle 10 may decide not to apply the second pull to the release cable. In that situation, if the hood panel 52 is pushed downward, the striker 114 will rotate the fork bolt 104 counterclockwise (as viewed in FIG. 3B), which will cause lost motion of the detent 152 relative to the release lever 150 (as illustrated in FIG. 7C) and restrain the fork bolt 104 with the detent 152. Therefore, the fork bolt 104 will be locked in position and the latching mechanism 100 will be in the fully latched position, as shown in FIGS. 2A and 2B, even though the hood panel 52 was never fully opened.

Alternatively, the operator may be in the process of closing the hood panel 52 and then decide not to. If the latching mechanism 100 is in the state shown in FIGS. 7A and 7B, the hood panel 52 cannot be reopened because the secondary catch 102 prevents removal of the striker 114. However, from those states, the operator could pull on the release cable—effectively the same as a second pull—to move the latching mechanism 100 from the secondary position to the fully actuated position and release the striker 114 and the hood panel 52 upward.

The detailed description and the drawings or figures are supportive and descriptive of the disclosure, but skilled artisans will recognize additional scope, as may be included in the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A vehicle comprising:

a vehicle body defining a compartment;

a hood panel adjustably mounted to the vehicle body and configured to selectively cover and uncover the compartment;

a striker fixedly attached to the hood panel; and a latching mechanism releasably engaging the striker, the latching mechanism including:

a housing secured to the vehicle body, and defining a striker channel into which the striker is selectively movable along a striker path;

a release lever pivotally connected to the housing, and configured to rotate in a first direction in response to a tensile force exerted by a release cable;

a detent pivotally connected to the housing and to the release lever, wherein the detent is movable with lost motion relative to the release lever;

a fork bolt adjustably connected to the housing and movable between a fully latched position, in which the fork bolt fixes the striker relative to the housing, and a secondary position, in which the striker is movable relative to the housing, wherein moving the fork bolt from the secondary position to the fully latched position causes the lost motion between the detent and the release lever;

a secondary catch pivotally connected to the housing, the secondary catch having a first lever arm, a second lever arm extending from the first lever arm at an acute angle, and a secondary hook portion extending from the first lever arm opposite the second lever arm;

a first biasing member operating bi-directionally to apply a force to selectively bias the secondary catch to rotate in opposing directions;

wherein the secondary catch is selectively pivotable between:

a first position, in which the secondary hook portion is aligned with the striker channel and blocks movement of the striker beyond the striker channel, and a second position, in which the secondary hook portion is not aligned with the striker channel along the striker path and the striker is moveable beyond the striker channel;

a cancel lever rotatably mounted to the second lever arm of the secondary catch opposite an intersection of the first lever arm and the second lever arm;

an arm extending from the cancel lever toward the first lever arm; and a cancel biasing member bi-directionally urging the cancel lever to rotate from a zero point in a first direction causing the cancel lever to engage the second lever arm, thus limiting rotation of the cancel lever in the first direction, and a second direction causing the cancel lever to rotate away from the second lever arm.

2. The vehicle of claim 1, wherein the cancel lever of the latching mechanism further includes:

an exterior cam surface formed on the arm extending from the cancel lever toward the first lever arm, and configured such that a force applied along the striker path onto the exterior cam surface, when the secondary catch is in the second position, induces a moment onto the second lever arm causing the secondary catch to rotate into the first position.

3. The vehicle of claim 2, wherein the cancel lever of the latching mechanism further includes:

an interior cam surface, wherein the exterior cam surface of the cancel lever transitions through an apex to the interior cam surface, wherein the apex extends sufficiently into the striker channel, when the secondary catch is in the second position, that the striker contacts the exterior cam surface upon closing the hood panel, and wherein the apex extends sufficiently into the striker channel, when the secondary catch is in the first position, that the striker contacts the interior cam surface upon opening of the hood panel.

4. The vehicle of claim 3, wherein the latching mechanism further includes:

a latch cam surface formed on the second lever arm of the secondary catch, wherein the latch cam surface is configured such that a force applied by the striker along the striker path onto the latch cam surface, when the secondary catch is in the second position, causes the secondary catch to pivot to the first position, even if the cancel lever is stuck rotated in the second direction.

5. The vehicle of claim 4, wherein the latching mechanism further includes:

a projection formed on the housing, wherein the projection engages the cancel lever and causes the cancel lever to rotate in the first direction, even if the cancel lever is stuck rotated in the second direction, as the secondary catch moves from the second position to the first position.

6. The vehicle of claim 1, wherein the cancel lever of the latching mechanism further includes:

an interior cam surface, wherein the cancel lever is configured to rotate in the second direction when the striker engages the interior cam surface as the striker is moved apart from the striker channel, thereby disengaging the striker from the latching mechanism.

7. The vehicle of claim 1, the latching mechanism is configured:

wherein the fork bolt is moved from the fully latched position to the secondary position and the secondary catch is moved from the second position to the first position in response to the tensile force from the release cable, and wherein the fork bolt is moved from the secondary position to the fully latched position and the secondary catch is moved from the second position to the first position, in response to a downward force from the striker.

8. The vehicle of claim 1, wherein the latching mechanism further includes:

a latch cam surface formed on the second lever arm of the secondary catch, wherein the latch cam surface is configured such that a force applied by the striker along the striker path onto the latch cam surface, when the secondary catch is in the second position, causes the secondary catch to pivot to the first position.

9. A latching mechanism to releasably engage a striker relative to a vehicle body, the latching mechanism comprising:

a housing configured to be secured to the vehicle body, and defining a striker channel into which the striker is selectively movable along a striker path;

a release lever pivotally connected to the housing, and configured to rotate in a first direction in response to a tensile force exerted thereupon;

a detent pivotally connected to the housing and to the release lever, wherein the detent is movable with lost motion relative to the release lever;

a fork bolt adjustably connected to the housing and movable between a fully latched position, in which the fork bolt fixes the striker relative to the housing, and a secondary position, in which the striker is movable relative to the housing, wherein moving the fork bolt from the secondary position to the fully latched position causes the lost motion between the detent and the release lever;

a secondary catch pivotally connected to the housing, the secondary catch having a first lever arm, a second lever arm extending from the first lever arm at an acute angle, and a secondary hook portion extending from the first lever arm opposite the second lever arm;

a first biasing member operating bi-directionally to apply a force to selectively bias the secondary catch to rotate in opposing directions;

wherein the secondary catch is selectively pivotable between:

a first position, in which the secondary hook portion is aligned with the striker channel and blocks movement of the striker beyond the striker channel, and a second position, in which the secondary hook portion is not aligned with the striker channel along the striker path and the striker is moveable beyond the striker channel;

a cancel lever rotatably mounted to the second lever arm of the secondary catch opposite an intersection of the first lever arm and the second lever arm;

an arm extending from the cancel lever generally toward the first lever arm; and a cancel biasing member bi-directionally urging the cancel lever to rotate from a zero point in a first direction causing the cancel lever to engage the second lever arm, thus limiting rotation of the cancel lever in the first direction, and a second direction causing the cancel lever to rotate away from the second lever arm.

10. The latching mechanism of claim 9, wherein the cancel lever of the latching mechanism further includes:

an exterior cam surface formed on the arm extending from the cancel lever generally toward the first lever arm, and configured such that a force applied along the striker path onto the exterior cam surface, when the secondary catch is in the second position, induces a moment onto the second lever arm causing the secondary catch to rotate into the first position.

11. The latching mechanism of claim 10, wherein the cancel lever of the latching mechanism further includes:

an interior cam surface, wherein the exterior cam surface of the cancel lever transitions through an apex to the interior cam surface, wherein the apex extends sufficiently into the striker channel, when the secondary catch is in the second position, that the striker contacts the exterior cam surface upon downward force from the striker, and wherein the apex extends sufficiently into the striker channel, when the secondary catch is in the first position, that the striker contacts the interior cam surface upon upward force from the striker.

12. The latching mechanism of claim 11, wherein the latching mechanism further includes:

a latch cam surface formed on the second lever arm of the secondary catch, wherein the latch cam surface is configured such that a force applied by the striker along the striker path onto the latch cam surface, when the secondary catch is in the second position, causes the secondary catch to pivot to the first position, even if the cancel lever is stuck rotated in the second direction.

13. The latching mechanism of claim 9, the latching mechanism is configured:

wherein the fork bolt is moved from the fully latched position to the secondary position and the secondary catch is moved from the second position to the first position in response to the tensile force, and wherein the fork bolt is moved from the secondary position to the fully latched position and the secondary catch is moved from the second position to the first position, in response to a downward force from the striker.

14. The latching mechanism of claim 9, wherein the latching mechanism further includes:

a latch cam surface formed on the second lever arm of the secondary catch, wherein the latch cam surface is configured such that a force applied by the striker along the striker path onto the latch cam surface, when the secondary catch is in the second position, causes the secondary catch to pivot to the first position.

* * * * *